US005583547A

United States Patent [19]

Gast et al.

[11] Patent Number: 5,583,547

[45] Date of Patent: Dec. 10, 1996

[54] DROP COUNT-BASED INK-JET PEN SERVICING METHOD

[75] Inventors: Paul D. Gast, Vancouver; Eva-Maria Moon, Washougal, both of Wash.; Steven B. Elgee, Portland, Oreg.

[73] Assignee: Hewlett-Packard Company, Palo Alto, Calif.

[21] Appl. No.: 513,252

[22] Filed: Aug. 10, 1995

Related U.S. Application Data

[63] Continuation of Ser. No. 951,255, Sep. 25, 1992.

[51] Int. Cl.[6] ..... B41J 2/165

[52] U.S. Cl. ..... 347/22; 347/33; 347/35

[58] Field of Search ..... 347/23, 22, 49, 347/17, 33, 7, 24, 14, 19, 35

[56] References Cited

U.S. PATENT DOCUMENTS

| | | | |
|---|---|---|---|
| 4,123,761 | 10/1978 | Kimura et al. | 346/140 R |
| 4,835,435 | 5/1989 | Yeung et al. . | |
| 4,853,717 | 8/1989 | Harmon et al. | 347/33 X |
| 5,049,898 | 9/1991 | Arthur et al. | 347/49 X |
| 5,166,699 | 11/1992 | Yano et al. | 346/140 X |
| 5,245,362 | 9/1993 | Iwata et al. | 347/23 |

FOREIGN PATENT DOCUMENTS

| | | | |
|---|---|---|---|
| 0442711A1 | 8/1991 | European Pat. Off. . | |
| 0447262A1 | 9/1991 | European Pat. Off. . | |
| 63-252748 | 10/1988 | Japan | 347/23 |
| 2003324 | 1/1990 | Japan | B41J 2/18 |
| 2141248 | 5/1990 | Japan . | |
| 3-234649 | 10/1991 | Japan | 347/23 |
| 4080041 | 3/1992 | Japan . | |

*Primary Examiner*—Benjamin R. Fuller
*Assistant Examiner*—David Yockey

[57] ABSTRACT

Automatic print rate-controlling and pen-servicing method and apparatus are described for power management and for determining appropriate servicing intervals for plural-pen ink-jet printers. The preferred method involves counting the number of drops of ink that are fired from each of plural pens in the printer's printhead carriage and optionally calculating the pen firing rate such that printer throughput can be controlled to limit time-averaged power and such that pen servicing frequency can be based upon the need for such servicing. The counts are maintained in memory connected, for example, with the printer's microcontroller, as are parameters that the microcontroller uses to determine appropriate drop count-based print rate controlling or pen servicing that reduce printer throughput only to the extent necessary. Particularly, the pens are serviced when any of the counts is within a predefined finite range of a predefined number or no later than when any of the counts exceeds a corresponding predefined number. The preferred apparatus includes a drop counter, a service station for wiping and spitting plural pens within a printhead carriage and a controller responsive to the drop counter to control the printing rate and to move the printhead carriage into operative association with the service station based upon drop count, firing rate, time-averaged power capability, printhead location and other predetermined criteria.

7 Claims, 1 Drawing Sheet

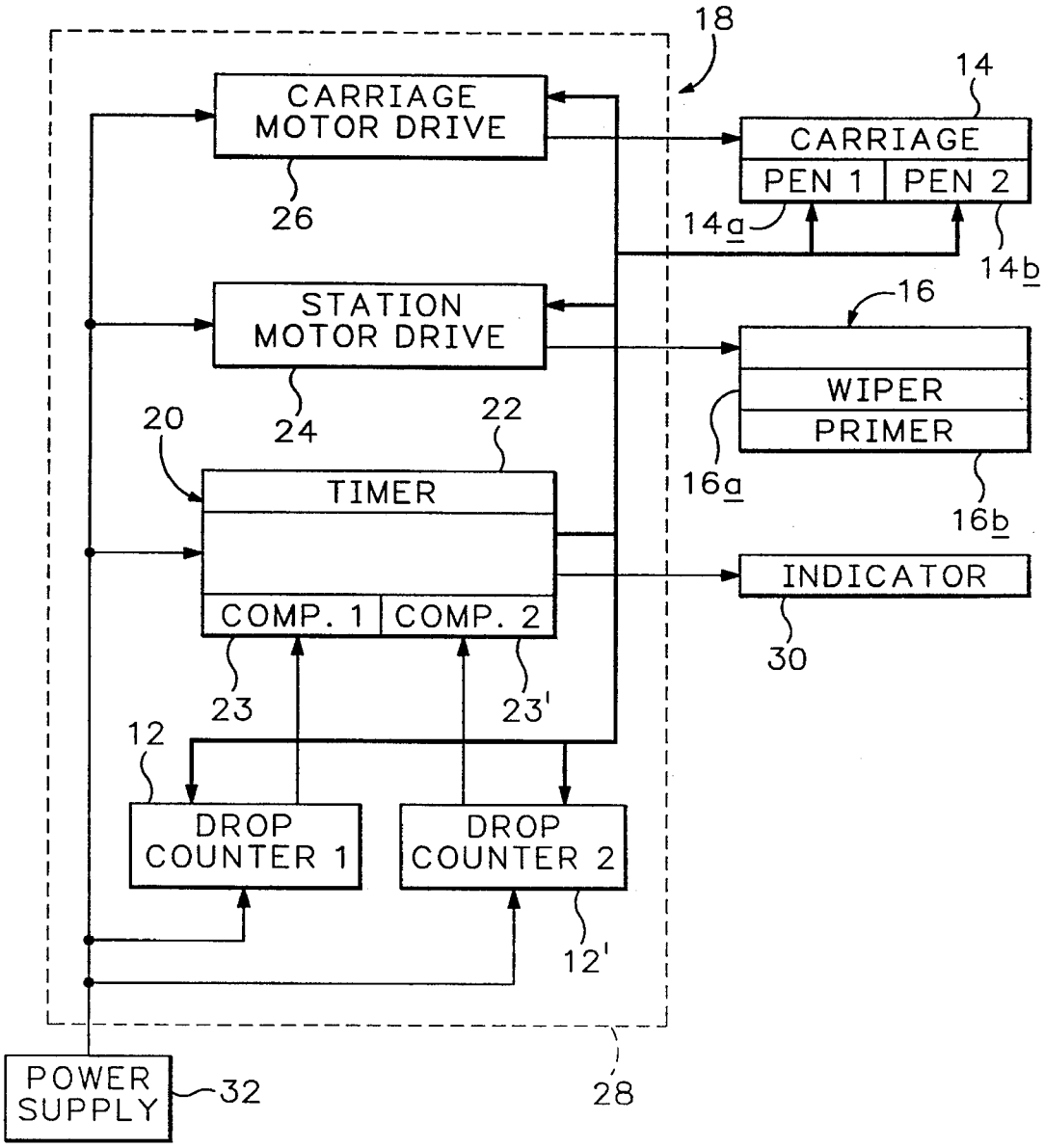
18
CARRIAGE MOTOR DRIVE
26
14
CARRIAGE
PEN 1
PEN 2
14a
14b
STATION MOTOR DRIVE
24
16
WIPER
PRIMER
16a
16b
20
22
TIMER
COMP. 1
COMP. 2
23
23'
INDICATOR
30
12
DROP COUNTER 1
DROP COUNTER 2
12'
POWER SUPPLY
32
28

DROP COUNT-BASED INK-JET PEN SERVICING METHOD

This is a file-wrapper-continuation of U.S. patent application Ser. No. 07/951,255 which was filed on Sep. 25, 1992.

TECHNICAL FIELD

The present invention relates generally to printing rate and pen servicing control of an ink-jet printer. More particularly, the invention concerns method and apparatus that provide for time-averaged power, or simply average power, management and pen servicing based, respectively, upon the number and rate of ink drops and pen firings or ejections.

Background Art

Conventionally, automatic ink-jet printhead pen servicing, e.g. spitting and wiping, has been performed at predefined intervals such as ends of pages. Pen servicing is performed at a throughput premium because it takes the printer temporarily out of service, even if only for a second or two. Such defined interval servicing unnecessarily penalizes throughput in cases where the ink is relatively sparse, since the pen typically does not require wiping or spitting at the end of a page the printing of which involves relatively few firings of the pen's ink jet.

Ink-jet printer output density—i.e. the percentage of a surface area on a printed page that contains ink—affects time-averaged power demand on the printer's power supply. Power supply design must accommodate power dissipation in the form of heat as a consequence of extended high throughput and ink density. It is possible of course simply to design a power supply for the worst case heat generation, but such is costly, perhaps prohibitively so. Further, it is difficult to predict the range of possible operational requirements that may be placed on an ink-jet printer's drive electronics, and, without means to measure such demand in a specific case, it is impossible to base print rate or service interval timing on anything but educated guesses.

The various pens of multi-pen ink-jet printers typically would have different servicing requirements. For example, a tri-color pen might require more frequent wiping in order to minimize intra-pen ink (inter-color) contamination, whereas a monochrome (black color) pen would require less frequent wiping because there is no possibility of intra-pen ink contamination. Black and colored inks, the depositing and drying characteristics of which are different because of their different formulations, also would have different wiping, spitting and other servicing requirements. With the advent of multi-pen ink-jet printers that include monochrome and multi-color pens, the pen servicing requirements of the printer become more complex, as the different pen types require different servicing intervals.

Moreover, color ink-jet printing presents special timing problems because proper mixing of the primitive color, i.e. magenta, cyan and yellow, inks for high quality color printing relies in part on previously deposited, differently colored ink's wetness. As a result, there is a maximum interval of time, e.g. approximately 3 seconds, within which color ink deposition by successive passes of the printhead carriage must be accomplished in order to avoid wait-banding hue shift. Accordingly, it is advisable to guard against servicing pens between multiple carriage passes in color ink-jet printing.

Disclosure of the Invention

The invented automatic pen servicing method and apparatus represents a solution to the problem of determining appropriate servicing intervals for plural-pen ink-jet printers. Automatic pen-servicing and print rate-controlling method and apparatus are described for time-averaged power management and for determining appropriate servicing intervals for plural-pen ink-jet printers. The preferred method involves counting the number of drops of ink that are fired from each of plural pens in the printer's printhead carriage and optionally calculating each pen's firing rate such that printer throughput can be controlled to limit time-averaged power and such that pen servicing frequency can be based upon the need for such servicing rather than upon prior simplistic assumptions. The counts are easily maintained in memory connected, for example, with the printer's microcontroller, as are parameters that the microcontroller uses to determine appropriate drop count-based opportunities for pen servicing that take the printer off-line only as often as necessary. The preferred apparatus includes a drop counter, a service station for wiping and spitting plural pens within a carriage and a controller responsive to the drop counter to control the printing rate and to move the printhead carriage into operative association with the service station based upon drop count, firing rate, middle of page and other predetermined criteria.

These and additional objects and advantages of the present invention will be more readily understood after a consideration of the drawing and the detailed description of the preferred embodiment.

BRIEF DESCRIPTION OF THE DRAWINGS

The drawing is a schematic block diagram of the invented apparatus in its preferred embodiment.

DETAILED DESCRIPTION OF THE PREFERRED EMBODIMENTS AND BEST MODE OF CARRYING OUT THE INVENTION

The included drawing illustrates the invented apparatus for time-averaged power management and automatic servicing of plural pens in an ink-jet printer in schematic block diagram form at 10. Apparatus 10 preferably includes one or more drop counter(s) 12 for determining the number of ink drops being fired or ejected from each pen of a printer's carriage 14, a service station 16 including at least a wiper **16*a* for wiping (and preferably also a spittoon for spitting and perhaps also a primer 16*b* for priming) each pen, and a controller 18 responsive to drop counter 12 for moving carriage 14 into operative engagement with service station 16 for pen servicing at least one of the pens. Such pen servicing including at least wiping, in accordance with the invented apparatus, is based at least in part upon the determined drop count. Preferably, controller 18 includes a microcontroller or microprocessor 20, a timer 22 and one or more motor drive circuits, e.g. station motor drive circuit 24 and carriage motor drive circuit 26 that respectively control the positions of service station 16 and carriage 14. It will be appreciated that drop counters 12, controller 18 and timer 22 constitute a part of the ink-jet printer's electronics 28**, which preferably are implemented in a custom large-scale integrated (LSI) semiconductor device such as an application-specific integrated circuit (ASIC).

Each of drop counters 12, 12' may be implemented in hardware, although within the spirit of the invention it may be implemented in firmware or software. The pen firing rate, or ink drop ejection rate, to which each drop counter 12 is responsive can be as high as approximately 250 kHz; so, a software or firmware implementation would require a dedicated, relatively high-speed microprocessor. It will be appreciated that drop counters 12 do not actually count ink drops, but instead count instances of an ink jet firing signal produced, for example, by microprocessor 20 in response to print commands from a printer driver such as a host computer or file server (not shown). Thus, invented apparatus 10 avoids the added complexity and weight—and the attendant cost—of a physical ink drop detector.

Those skilled in the arts will appreciate that microprocessor 20, responsive to drop counters 12 and timer 22 (which of course may be an integral part of microprocessor 20), straightforwardly calculates average ink drop or ink jet firing rates for each pen in printhead carriage 14. Preferably, both the drop counts and calculated rates are stored as data within volatile or non-volatile memory locations (not shown) that form a part of microprocessor 20. It will be understood that if printhead carriage 14 includes, for example, a black ink pen 14*a* and a tri-color ink pen 14*b* then two drop counters 12 would develop drop counts to which microprocessor 20 is responsive to store two drop counts and two pen firing rates representative of the ink drop demands being placed on all nozzles within each pen of the ink-jet printer. Of course, any number of drop counts and corresponding firing rates may be determined and stored for use in automatic time-averaged power management and pen servicing in accordance with the invention.

Optionally, controller 18 may include a comparator, e.g. a logical comparator implemented in microprocessor 20, for comparing the number of ink drops fired to predicted pen life criteria. Such criteria may be empirically determined, and would represent average pen life for a pen of the type(s) used in printhead carriage 14. Also optionally, apparatus 10 further may include an audio, visual or other indicator 30 responsive to controller 18 for indicating a low-ink condition of one or more pens, as determined by counting the number of drops fired therefrom and based upon such comparison. In this way, an ink-jet printer could annunciate to its user when one or more pens is nearly exhausted of ink, based upon measured usage data and predicted evaporation rate, average drop size and other empirically determined information. Illustratively, apparatus 10 might signal the user via one or more indicators such as indicator 30 when there is approximately 1 centimeter$^3$ (1 cc) of ink remaining in a given pen within printhead carriage 14 so that the user might replace it before print quality suffers or the pen becomes empty. (It will be understood that in order to comprehend long-term pen life drop counts, drop counts stored for such purpose would be stored in non-volatile memory so that they are preserved during power down or power off conditions of the printer.)

Apparatus 10 may be understood to be capable automatically of managing time-averaged power delivered to electronics 28 of an ink-jet printer. Apparatus 10 includes a power supply 32 characterized as having a predefined time-averaged power delivery capability, e.g. the power to sustain continuous printing at a print density of 50% of solid black or colored ink within the printable surface area of a printed page. This is because apparatus 10 includes one or more drop counters 12 for determining the number of ink drops being fired from corresponding pens of a printer's carriage and controller 18 including microprocessor 20 responsive thereto for controlling the printing rate via control of carriage motor drive circuit 26 connected with printhead carriage 14. Such control is performed in such manner that the rated, predefined time-averaged power delivery capability of power supply 32 is not exceeded.

In other words, microprocessor 20 straightforwardly is programmed to control the average rate at which carriage drive motor 26 makes successive printhead carriage 14 passes, thereby limiting the average printing rate or throughput so that the rated power available from power supply 32 is not exceeded. Preferably, controller 18 calculates (e.g. via microprocessor 20) one or more ink drop firing rates based upon counts produced by one or more drop counters, 12' and compares the same via comparators 23, 23' to corresponding predefined maximum firing rates that are stored in a memory location (e.g. within microprocessor 20). Preferably, controller 18 does so by interposing a defined delay (which may be provided by timer 22) between printhead carriage passes, which delay is varied during printing to limit the ink jet firing rates for all pens within printhead carriage 14 not to exceed the predefined, stored time-averaged power level or threshold. Those skilled in the arts will appreciate that, while carriage motor drive and ink jet firing currents are not the only power demands on power supply 32, they account for most of the variable load, as has been determined by thermal analysis of ink-jet printers.

The preferred pen servicing and power management methods of the invention now may be understood, by reference to the preferred apparatus described and illustrated herein. Preferably pen servicing includes counting the number of drops fired, i.e. the number of ink jet firings, from a pen to produce a count and, based thereon, automatically servicing such pen when the first count exceeds a predefined number. It will be appreciated that the predefined number may be a minimum such as zero where drop counters 12 are down counters preset to a maximum number of drops or firings. It will be appreciated that, alternatively, the predefined number may be a maximum such as 800,000 or 2,620,000 where drop counters 12 are up counters that are reset to zero. These and other alternative counting methods are within the spirit and scope of the invention.

Preferably, pen servicing is performed at the beginning or end of a printed line, depending upon the location of service station 16. This minimizes the carriage travel time to and from service station 16. In accordance with the preferred embodiment of the invention in which service station 16 is located on the right side of carriage 14, pen servicing is performed at the end of a printed line. In servicing the pen, printhead carriage 14 preferably is moved at high speed into operative engagement with service station 16, and back, in order to minimize total print-interrupting service cycle times. Thus, the possibility of wait-banding hue shift is minimized.

In accordance with the preferred method of the invention, pen servicing is performed mid-page (and, consequently, at the end of a printed line) if and when a predefined black or color drop count has been exceeded, as it has been determined that this minimizes low-quality printing that otherwise might result from ink clogging or leakage in and around the pen's orifices or nozzles or the surrounding surfaces. In the case of a multi-color pen, such also minimizes low-quality printing that otherwise might result from intra-pen ink flow and color contamination. Of course, it may be necessary in variable-density print situations to service the pens more or less often to achieve a desired high throughput yet without compromising print quality. The invented apparatus and method achieve this demand-based servicing goal on what might be referred to as a "pay-as-you-go" basis.

In accordance with the preferred method of the invention, pen servicing is performed as follows. If a drop count exceeds the predefined first count (e.g. 800,000 color drops or 2,620,000 black drops mid-page by which is meant at the end of any line of the page except the last), or is within approximately 25–30% thereof at the end of a page, then pen servicing is started immediately. Preferably, servicing includes high-speed, bi-directional wiping of both the black and the tri-color pens, and restarting of drop counters 12. Servicing also preferably includes spitting all nozzles of both pens. Most preferably, if the servicing requirement was based upon a black drop count threshold being exceeded, then servicing includes spitting the black pen more times than the color pen. Also, most preferably, if the servicing requirement was based upon a color drop count threshold being exceeded, then servicing includes spitting the color pen more times than the black pen. This is why preferably there are individual drop counters 12 for the individual pens within printhead carriage 14. If no pen's drop count exceeds the predefined mid-page or end-of-page thresholds, then no pen servicing takes place on the given page of printout. (Of course, other servicing irrespective of drop counts may take place, e.g. at printer power up, during the first and last pages of each print job and when the user replaces a pen or otherwise manually invokes pen servicing.)

It will be appreciated that servicing is performed, in accordance with the preferred method, when the count exceeds a predefined number, e.g. 800,000 or 2,620,000 drops, mid-page, or when the count exceeds a predefined percentage, e.g. 25–30%, thereof at the end of a page. This avoids unnecessarily frequent pen servicing, yet maintains overall print quality of each and every page. Moreover, it favors servicing between pages, thereby least impacting throughput and avoiding potentially highly visible, mid-page (color) hue shifts. Preferably the invented method is used in connection with a printer that includes plural pens of different types, e.g. a black pen and a tri-color pen, wherein there is counting of the number of drops fired from the plural pens to produce plural counts and wherein servicing is performed when any one of the counts exceeds a corresponding predefined count for that pen type. More preferably the invented method of automatically servicing such plural pens includes spitting the plural pens predefined numbers of times based upon which of the plural counts exceeds a corresponding predefined count, as described above.

It will be appreciated that servicing also may include pen priming, e.g. by the use of a vacuum pump connected to the pen's cap. Other maintenance or failure recovery steps also may be taken during servicing, based in whole or part on drop counts as defined herein. For example, the method may include indicating to the user via indicator 30 when one or more counts produced by drop counters 12 exceeds a threshold number predetermined to be indicative of a low-ink condition of the corresponding pen.

The preferred time-averaged power management method now may be understood to include counting the number of ink drops fired from a pen over a defined time interval to produce a count and, based thereon, automatically rate controlling printing when such count over such interval exceeds a predefined number. Such may include calculating an ink drop firing rate based upon such count and such time interval, whereby such rate controlling is performed when the firing rate exceeds a predefined threshold rate. As described above in reference to apparatus 10, such rate controlling preferably includes controlling the rate of printhead carriage movement, e.g. by microprocessor 20 controlling the movement of printhead carriage 14 via carriage motor drive circuit 26. It also is preferred that such rate controlling includes selectively (e.g. every time, every other time, every nth time, etc.) interposing a defined time delay (e.g. via microprocessor 20 and timer 22) between printhead carriage passes, i.e. selectively delaying or pausing between printed lines by a variable amount of time based at least in part on the measured drop count and the derived, e.g. calculated, firing rate for each pen in printhead carriage 14.

Industrial Applicability

It may be seen that the invented method and apparatus for automatic time-averaged power management and plural-pen printhead servicing of ink-jet printers adapt themselves in real time to actual printer usage, and do not unnecessarily penalize throughput in varied printer applications. The savings include lower cost of the printer's power supply and the benefits include extended useful life of the printhead, e.g. pens and carriage motor, and the service station, e.g. wipers. Still, high print quality is not compromised, but instead is maintained, because printhead service frequency is based upon actual ink delivery demands placed on the ink-jet printer. The drop count or pen firing rate basis for pen servicing and time-averaged power management lends itself to solving other problems, e.g. the ink depletion gauging and warning system described above.

While the present invention has been shown and described with reference to the foregoing operational principles and preferred embodiment, it will be apparent to those skilled in the art that other changes in form and detail may be made therein without departing from the spirit and scope of the invention as defined in the appended claims.

We claim:

1. A pen servicing method for use in an ink-jet printer having plural different pens, said method comprising the steps of:

counting drops fired from each of said pens to produce plural counts and based thereon, upon completing printing of a page, comparing each of said counts to a predefined number, and automatically directing servicing of the pens upon completing printing of the page only where any of said counts is within a predefined finite range of said predefined number; and automatically servicing said pen no later than when any of the counts exceeds a corresponding predefined number.

2. The method of claim 1, wherein said servicing includes wiping the pens.

3. The method of claim 1, wherein said servicing includes spitting the pens.

4. The method of claim 1, wherein said servicing includes priming the pens.

5. The method of claim 1 which further includes indicating when any of said counts exceeds said predefined number.

6. A pen servicing method for use in an ink-jet printer, said method comprising the steps of:

counting drops fired from the pen since last serviced to produce an ink drop ejection count;

upon completing printing of a page, comparing said ink drop ejection count to a predefined number, and servicing the pen and resetting the ink drop ejection count upon completing printing of a page only where said ink drop ejection count has not yet reached said predefined number, but is within a predefined finite range of said predefined number; and servicing the pen and resetting the ink drop ejection count where the ink drop ejection count reaches said predefined number.

7. The method of claim 6, wherein said predefined finite range is defined between said predefined number and within approximately 30 percent of said predefined number.

* * * * *